United States Patent [19]

Foresman

[11] Patent Number: 4,567,839

[45] Date of Patent: Feb. 4, 1986

[54] SAIL FURLING STRIP

[76] Inventor: Robert R. Foresman, 26902 Paseo Cardero, San Juan Capistrano, Calif. 92675

[21] Appl. No.: 505,806

[22] Filed: Jun. 20, 1983

[51] Int. Cl.[4] ..... B63H 9/04

[52] U.S. Cl. ..... 114/102; 242/1; 242/55

[58] Field of Search ..... 114/90, 102, 103, 104, 114/105, 106, 107, 108, 39; 242/1, 55

[56] References Cited

U.S. PATENT DOCUMENTS

| | | | |
|---|---|---|---|
| 27,316 | 2/1860 | Simpson | 114/107 |
| 3,835,804 | 9/1974 | Jackson | 114/107 |
| 4,090,461 | 5/1978 | Rusich | 114/107 |
| 4,211,179 | 7/1980 | Saunders | 114/90 |
| 4,269,134 | 5/1981 | Shapland | 114/107 |

*Primary Examiner*—Galen L. Barefoot
*Assistant Examiner*—Jesûs D. Sotelo
*Attorney, Agent, or Firm*—G. Donald Weber, Jr.

[57] ABSTRACT

A strip which is attached to or formed with a sail, adjacent the luff edge thereof, and which improves the furling operation relative to the sail and permits improved mast design.

6 Claims, 2 Drawing Figures

SAIL FURLING STRIP

BACKGROUND

1. Field of the Invention

This invention is directed to a means for furling sails, in general, and to a strip for use with a sail during the furling operation, in particular.

2. Prior Art

There are many sailboat enthusiasts throughout the world. Each of these enthusiasts is looking for improved equipment and technique to permit greater utilization of the sailing equipment. One area of improvement is in the furling technique and equipment therefor relative to the sails used with the boat. Many types of equipment have been designed and utilized with sailboats.

In particular, one of the types of equipment which is used is a type of furling mast or a mast with furling equipment associated therewith. Typically, this type of mast is hollow with a slot at either the fore or aft side thereof. The sail is attached to a furling means mounted within the mast, generally along the major portion of the axis thereof. The sail is attached to this furling equipment of this nature and passes through the slot in the mast.

Reference is made to U.S. Pat. No. 3,835,804, SAIL FURLING, by P. T. Jackson. This patent teaches a sail which is furled upon an upright wind-up member such as a rotatable cable to which the luff of the sail is affixed. The Jackson patent teaches a mast which comprises a rigid shell having a vertically disposed interior chamber and a vertical opening in the aft portion of the mast. In the Jackson patent, the luff of the sail is attached to the cable which forms the wind-up member. The Jackson patent specifically recites that the wind-up member is a cable, is flexible, and has a diameter which is smaller than the width of the opening in the mast. Consequently, the wind-up member can sag or bow under certain stress. This permits the sail to gape and provide an inefficient said configuration. In addition, the Jackson patent teaches that the wind-up member with a sheath or the sail luff attached thereto becomes rigid, and is wider than the slot in the mast. This reduces the tendency of the sail edge to slip out of the hollow mast. However, great difficulty is experienced in removing the furling mechanism from the mast. Thus, a change in sail, modification to the sail, exchange or repair of sails or the like necessitate a difficult task for the sailboat owner.

Another patent which teaches sail furling devices is U.S. Pat. No. 4,090,461, SAILBOAT MAST CONTAINING SAIL FURLING DEVICE WITH SWIVEL HAUL-UP MEANS, by A. Rusich. This patent teaches a similar furling system but with a more detailed description of the components of the furling means, per se. In the Rusich patent the wind-up means is defined as a flexible rod which surrounds cable-like tension means. More importantly, the rod includes a C-shaped groove therein for retaining the bead of a sail. Again, in the Rusich patent difficulty is found in servicing the sail within the mast. Also, a rod is placed over a cable which increases complexity of the wind-up means.

Another approach to the sail furling techniques is to provide a mast with an extremely wide slot. In this type of mast, the opening is far wider than the diameter of the wind-up means. Frequently, the opening is wider than the diameter of the furled sail. This arrangement has the clear difficulty of permitting a gaping sail configuration.

SUMMARY OF THE INVENTION

This invention is directed to a furling strip which is formed with or attached to a sail adjacent the luff edge thereof. The strip includes a plurality of elongated trapezoidal shaped elements which can be joined together as a single unit or separately attached to the sail, as desired. Substantially triangular pieces are located at each end of the plurality of adjacent trapezoidal elements. The strip elements, individually or as a unit, are mounted on the sail and wound around a rotating wind-up member in a hollow, slotted mast and permit said furling therein.

DESCRIPTION OF A PREFERRED EMBODIMENT

Figure 1:
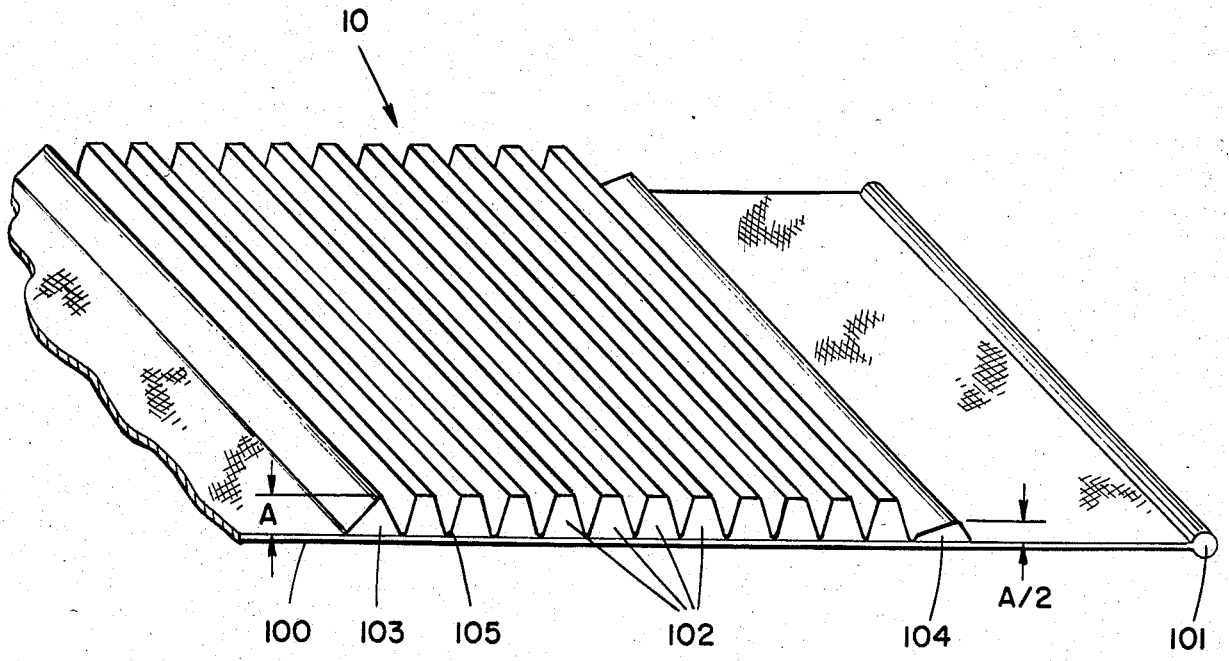
FIG. 1 is a perspective cross-sectional view of one embodiment of the instant invention.

Referring now to FIG. 1, there is shown a cross-sectional view perspective of one embodiment of the furling strip 10 of the instant invention. In this embodiment, the furling strip is, typically, formed as a unitary element and may be formed of a polymer, a composite or other similar and suitable material. In some cases, the material can be resilient to avoid pounding of the sail material in use. In any event, the material is, preferably formed of a material which will not be adversely affected by a moist environment.

In the embodiment shown in FIG. 1, a plurality of substantially identical trapezoidal sections 102 are provided. The number of the sections or "teeth" is a function of the diameter of the furling rod which is to be used with the apparatus as described hereinafter. That is, the sloped, substantially vertical, sides are arranged to abut against the sides of the neighboring elements or "teeth" in a snug fashion. Thus, when rolled on the furling rod, the teeth of the strip will abut one another and form a solid, cylindrical configuration. The inner surface of the cylinder will be multi-sided as defined by the number of teeth in the element.

One end piece or tooth 103 is generally triangular in shape with the vertically disposed side leg or surface thereof which is adjacent to a tooth 102 of approximately the same length or dimension of the vertically disposed side of tooth 102.

The opposite end member 104 is also substantially triangular in configuration but with a much shallower slope and lower height dimension. Again, the vertically disposed surface of tooth 104 which is adjacent to a tooth 102 has substantially the same length as the vertically disposed surface of tooth 102. Typically, the height A/2 of tooth 104 is about one-half the height A of tooth 102.

In one embodiment shown in FIG. 1, the strip 10 has all of the teeth formed together as an integral unit. That is, a relatively small radius 105 is defined at the junction of the bottom end of the sloped edges of each of the teeth 102. This radius is, effectively, described and developed by the manufacturing process for making strip 10. In fact, the radius need not be actually a radius but can be an angle or the like if so desired. In this embodiment, the strip 10 can be made by extruding a single unit with all of the teeth interconnected.

In this arrangement, the strip 10 is affixed to a sail 100 in any suitable fashion such as by sewing, an adhesive, riveting or the like. The strip 10 is affixed to the sail 100 rather closely adjacent to the sail luff (or bead) 101.

In an alternative embodiment, if a unitary strip 10 is not fabricated, each of the teeth 102, 103 and 104 can be individually fabricated and individually mounted on the sail 100 in the same general configuration as shown.

Figure 2:
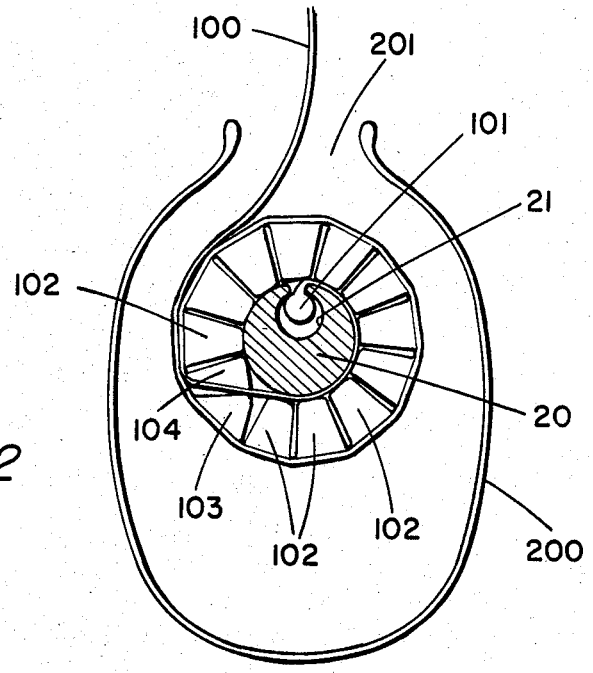
FIG. 2 is a cross-sectional view of the instant invention in a furled condition.

Referring now to FIG. 2, there is shown a cross-sectional view of the furling strip 10 when wrapped around a furling rod 20 within an open mast 200. The particular rod 20 includes a C-shaped groove 21 therein. The luff 101 of sail 100 is inserted into the slot 21 and maintained therein. In the illustration of FIG. 2, the rod 20 within mast 200 has been rotated approximately one and one-half revolutions so that the furling strip 10 is wrapped completely around rod 20. In this instance, it is seen that the trapezoidal teeth 102 are arranged with the inner surface thereof mounted adjacent to the circumference of rod 20. As noted supra, the dimensions of teeth 102, 103 and 104 are designed to properly mate with the dimensions of rod 20. Thus, strip 10 (especially the teeth thereof) form a substantially solid cylinder around rod 20. This prevents any snagging of the sail, flat spots or rubbing areas of the sail on edges of the furling strip 10.

Element 200 is a schematic representation of a mast with an aft facing slot 201. It is seen that sail 100 passes through slot 201 in being furled or unfurled.

It is especially noted that slot 201 is designed to have a width which is greater than the diameter of rod 20. Thus, rod 20 can be readily moved through slot 21 for servicing or the like. However, when rod 20 has been rotated and furling strip 10 has been wrapped around rod 20, the diameter of the combination is increased so that it is greater than the width of slot 201 in mast 200. This has the advantageous effect of preventing the sail from pulling out of the mast.

Thus, there has been shown and described a furling strip which can be used in conjunction with a sail on a hollow furling mast. The furling strip is attached to the sail whereby the furling rod can be made smaller than the slot or opening in the mast. Thus, the furling rod can be removed readily for any purposes so desired. However, by merely taking one to one and a half revolutions of the rod so that the furling strip is wrapped therearound, the rod can no longer pass through the slot in the mast. This provides advantageous sailing characteristics. The furling strip can be provided as an extension to the sail wherein the sail configuration is not distorted by taking the one to one and a half revolutions.

A typical configuration of the furling strip and suggested materials for manufacture have been made. Of course, any modification to the specific materials or arrangements are intended to be included in this description. That is, the description is intended to be illustrative only and not to be limitative. The scope of the invention is limited only by the claims appended hereto.

Having thus described a preferred embodiment of the instant invention what is claimed is:

1. A furling strip for use with sails in a hollow furling mast on a sailboat comprising, a plurality of trapezoidal elements of substantially similar size and configuration arranged in side-by-side manner, a pair of end elements respectively disposed at opposite sides of said plurality of trapezoidal elements and having compatible shapes so that a substantially trapezoidal configuration substantially similar to the configuration of said trapezoidal elements is made by two elements when abutted against each other, and means for mounting said elements on a sail for use in conjunction with a hollow furling mast.

2. A sail furling mechanism comprising, a hollow mast, a sail furling element disposed within said hollow mast, a sail mounted to said sail furling element, said mast having a slot therein through which said sail can move, said sail furling element is smaller in width than said slot, wherein said sail furling element is capable of moving through said slot, and a furling strip attached to said sail adjacent said sail furling element wherein the partial furling of said sail on said sail furling element within said mast causes the diameter of said partially furled sail to be significantly increased whereby said partially furled sail cannot pass through said slot.

3. The mechanism recited in claim 2 wherein, said strip is smaller in thickness than said slot so that said strip can pass through said slot until wound about said element.

4. The mechanism recited in claim 2 wherein, said furling strip is attached at the edge of said sail such that strip can be furled without reducing the useful sail surface.

5. The mechanism recited in claim 2 wherein, said furling strip surrounds said element after about 1½ rotations of said element.

6. The mechanism recited in claim 2 wherein, said furling strip includes a plurality of elongated, trapezoidally shaped members which are arranged in side-by-side relation.

* * * * *